US008580474B2

(12) United States Patent
Yoshino et al.

(10) Patent No.: US 8,580,474 B2
(45) Date of Patent: Nov. 12, 2013

(54) ELECTROSTATIC IMAGE DEVELOPING CARRIER, ELECTROSTATIC IMAGE DEVELOPER, IMAGE-FORMING METHOD, DEVELOPER CARTRIDGE, PROCESS CARTRIDGE, AND IMAGE FORMING APPARATUS

(75) Inventors: Susumu Yoshino, Kanagawa (JP); Sumiaki Yamasaki, Kanagawa (JP); Satoshi Hiraoka, Kanagawa (JP); Shigeru Seitoku, Kanagawa (JP); Hirofumi Shiozaki, Kanagawa (JP); Kazuhiko Yanagida, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 290 days.

(21) Appl. No.: 13/047,263

(22) Filed: Mar. 14, 2011

(65) Prior Publication Data

US 2012/0015291 A1 Jan. 19, 2012

(30) Foreign Application Priority Data

Jul. 14, 2010 (JP) ..... 2010-160064

(51) Int. Cl.
*G03G 9/113* (2006.01)
*G03G 9/08* (2006.01)

(52) U.S. Cl.
USPC ..... 430/111.35; 430/105

(58) Field of Classification Search
USPC ..... 430/111.35, 105
See application file for complete search history.

(56) References Cited

U.S. PATENT DOCUMENTS 5,204,204 A * 4/1993 Shintani et al. ..... 430/111.35
5,753,397 A * 5/1998 Nakayama ..... 430/108.4

FOREIGN PATENT DOCUMENTS

| | | |
|---|---|---|
| JP | A-5-216281 | 8/1993 |
| JP | A-8-76485 | 3/1996 |
| JP | A-10-104885 | 4/1998 |
| JP | A-2004-170689 | 6/2004 |
| JP | A-2005-24809 | 1/2005 |
| JP | A-2006-78918 | 3/2006 |

* cited by examiner

*Primary Examiner* — Jonathan Jelsma
(74) *Attorney, Agent, or Firm* — Oliff & Berridge, PLC

(57) ABSTRACT

An electrostatic image developing carrier includes a core particle and a coating layer on the core particle. The coating layer contains a resin having a crosslinked structure formed by using at least one compound selected from boric acid and boric acid derivatives.

9 Claims, 2 Drawing Sheets

ELECTROSTATIC IMAGE DEVELOPING CARRIER, ELECTROSTATIC IMAGE DEVELOPER, IMAGE-FORMING METHOD, DEVELOPER CARTRIDGE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2010-160064 filed Jul. 14, 2010.

BACKGROUND

Technical Field

The present invention relates to an electrostatic image developing carrier, an electrostatic image developer, an image-forming method, a developer cartridge, a process cartridge, and an image forming apparatus.

SUMMARY

An electrostatic image developing carrier includes a core particle and a coating layer on the core particle. The coating layer contains a resin having a crosslinked structure formed by using at least one compound selected from boric acid and boric acid derivatives.

BRIEF DESCRIPTION OF THE DRAWINGS

Exemplary embodiments of the present invention will be described in detail based on the following figures, wherein.

DETAILED DESCRIPTION

Figure 1:
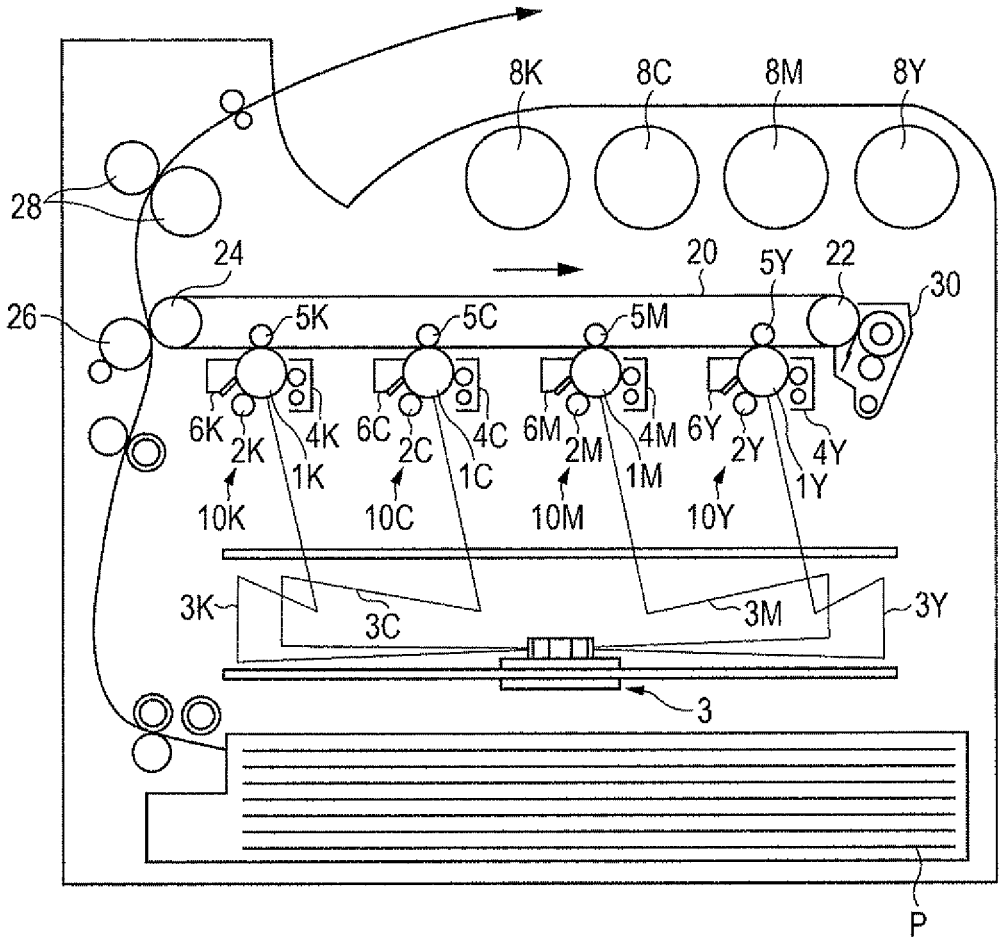
FIG. 1 is a schematic diagram showing an example of an image forming apparatus according to an exemplary embodiment.

Exemplary embodiments of an electrostatic image developing carrier, an electrostatic image developer, an image-forming method, a developer cartridge, a process cartridge, and an image forming apparatus of the present invention are described in detail below.

[Electrostatic Image Developing Carrier]

An electrostatic image developing carrier according to an exemplary embodiment of the invention (hereinafter, also referred to as "carrier") includes a core particle and a resin adhering on a surface of the core particle and having a crosslinked structure derived from at least one of boric acid and derivatives thereof (also referred to as "boric acid or the like" hereinafter).

The boron crosslinked resin is a resin having a crosslinked structure (structure in which two or more functional groups in a polymer compound are bonded to each other through boron atoms) resulting from reactions between boric acid or the like and two or more functional groups (groups reactive to boric acid or the like) contained in a polymer compound. To be more specific, in the case where boric acid is reacted with two OH groups (groups reactive to boric acid or the like) in a polymer compound, a crosslinked structure having a —O—B—O— structure is formed as a result of dehydration reaction, and the —O—B—O— structure is regarded as functioning as a link that bonds the two OH groups to each other. In other words, in a boron crosslinked resin, the boron atoms contribute to formation of the crosslinked structure. Hereinafter, a crosslinked structure formed by contribution of a boron atom may be referred to as "boron crosslinked structure".

The two or more functional groups (groups reactive to boric acid or the like) in the polymer compound may be contained in one molecule or two or more different molecules. In other words, two or more sites in one molecule of the polymer compound may be linked with each other through a boron atom, or different molecules of the polymer compound may be linked with each other through a boron atom.

The carrier according to the exemplary embodiment includes a boron crosslinked resin adhering on the core surface. Thus, fogging occurring in a non-image portion downstream of an image portion in the sheet transport direction (hereinafter also referred to as "fogging") is suppressed. Although the exact reason for this is not clear, following can be presumed.

That is, because the carrier of the exemplary embodiment includes the boron crosslinked resin adhering on the surfaces of the core particles, the hardness of the resin layer (hereinafter also referred to as "coating layer") adhering on the surface of each core particle is high compared to when the resin adhering on the surface of the core particle does not have a crosslinked structure. Presumably due to this reason, aggregation of the carrier is suppressed and flaking or wear of the coating layer caused by stirring inside a developing unit is suppressed according to the exemplary embodiment. The decrease in charge-imparting capacity of the carrier caused by flaking or wear of the coating layer is suppressed, and fogging caused by scattering of low charge toner particles over a non-image portion is also suppressed. In particular, when a toner supplied after consumption of a large amount of toner needs to be instantly charged while ensuring a sufficient charge amount as in the case of forming a character image after formation of a solid image and when an image that includes a non-image portion is formed, fogging that is likely to occur in the non-image portion is suppressed. It should be noted that the "coating layer" is a layer that coats at least a portion of the surface of the core particle and some parts of the portion of the core particles may be left uncoated (exposed).

Since the coating layer of the carrier of the exemplary embodiment contains a boron crosslinked resin, the hardness of the coating layer is low compared to the coating layer containing a crosslinked resin (e.g., a polyimide resin or a melamine resin) other than the boron crosslinked resin. Thus, the surfaces of the carrier are more susceptible to polishing during stirring in the developing device. Consequently, this presumably suppresses contamination of the carrier surfaces with toner components, the decrease in charge-imparting capacity of the carrier caused by the contamination, and fogging.

The fogging is also suppressed with a carrier produced by heating, in a gas phase (without using a solvent), a mixture of core particles and a resin in a step of causing the resin to adhere onto the surfaces of the core particles (in other words, a step of forming a coating layer on a surface of a core particle. This step may hereinafter be referred to as "coating step"). Although the exact reason for this it not clear, following can be presumed.

Because the coating layer of the carrier of the exemplary embodiment contains a boron crosslinked resin, the boron crosslinked structure dissociates as a result of heating. Compared to when a crosslinked resin other than the boron crosslinked resin is used, the hardness of the resin decreases significantly by heating and this decreases the viscosity of the resin during the coating step. As a result, the coating tends to be more uniform compared to when the viscosity of the resin is high. When the coating is not uniform, the charge-imparting capacity of the carrier becomes nonuniform, the charge amount distribution of the toner tends to be wide, and the toner with low charge amounts scatters over the non-image portion, thereby causing fogging. However, such fogging can be suppressed by using the carrier of the exemplary embodiment.

Fogging is also suppressed by forming an image by using the carrier of the exemplary embodiment under a condition where the moving speed of the surface of a developer-carrying member moves is 1.5 to 5.0 times or about 1.5 to 5.0 times the moving speed of the surface of the image-carrying member. The moving speed of the surface of the developer-carrying member refers to a speed at which the surface of the developer-carrying member moves by the operation of an image forming apparatus. For example, when the developer-carrying member has a cylindrical shape, the moving speed is proportional to the diameter and the angular velocity of the developer-carrying member. The same applies to the image-carrying member.

The speed of stirring the developer inside the developing unit increases and the impact applied to the carrier increases with the moving speed of the surface of the developer-carrying member. However, according to the exemplary embodiment, since flaking or wear of the coating layer caused by stirring is suppressed, fogging is suppressed even when the moving speed of the surface of the developer-carrying member is greater than the moving speed of the surface of the image-carrying member and the speed ratio is within the above-described range.

The materials, process conditions, and evaluation/analysis conditions employed in the exemplary embodiments are described in detail below.

<Boron Crosslinked Resin>

The boron crosslinked resin is described first.

As discussed earlier, a boron crosslinked resin is a resin having a crosslinked structure resulting from reactions between boric acid or the like and two or more functional groups (groups reactive to boric acid or the like) contained in a polymer compound.

—Boric Acid and Boric Acid Derivatives—

Examples of the boric acid and derivatives thereof include unsubstituted boric acid and boric acid derivatives such as organic boric acids, boric acid salts, and boric acid esters.

Examples of the organic boric acids include n-butyl boric acid, 2-methylpropyl boric acid, phenyl boric acid, o-tolyl boric acid, p-tolyl boric acid, and 4-methoxyphenyl boric acid.

Examples of the boric acid salts include inorganic boric acid salts and organic boric acid salts, e.g., sodium tetraborate and ammonium borate.

Examples of the boric acid esters include trimethyl borate, triethyl borate, tri-n-propyl borate, triisopropyl borate, tri-n-butyl borate, tri-tert-butyl borate, triphenyl borate, diisopropyl borate, butyl diisopropyl borate, trihexyl borate, tri-2-ethylhexyl borate, trioctadecyl borate, tritetradecyl borate, and triphenoxy borate. The boric acid esters may have a cyclic structure. Examples of the cyclic boric acid esters include 2,4,6-trimethoxyboroxin and 2,4,6-trimethylboroxin. These compounds may be anhydrous or hydrated but are preferably anhydrous. Among the boric acid and its derivatives, boric acid, trimethyl borate, triethyl borate, and triisopropyl borate are preferred.

—Polymer Compound Having Groups Reactive to Boric Acid or the Like—

Examples of the polymer compound that forms a boron crosslinked resin when reacted with boric acid or the like include polymer compounds having groups reactive to boric acid or the like (may be referred to as "boric acid reactive group" hereinafter). An example of the boric acid reactive group is an OH group. Examples of the polymer compound having the boric acid reactive group include polymer compounds that contain constitutional units derived from the monomers having the boric acid reactive group. The polymer compound may contain constitutional units derived from other monomers in addition to the constitutional unit derived from the monomer having the boric acid reactive group. In other words, the polymer compound may be a homopolymer made from a monomer having a boric acid reactive group or a copolymer of the monomer having the boric acid reactive group and another monomer.

The polymer compound having the boric acid reactive group may be obtained by polymerizing a monomer having the boric acid reactive group, copolymerizing the monomer having the boric acid reactive group and another monomer, introducing a boric acid reactive group into a polymer compound having no boric acid reactive group, or introducing another boric acid reactive group into the polymer compound having a boric acid reactive group.

When the polymer compound having the boric acid reactive group is a copolymer of a monomer having a boric acid reactive group and another monomer, the ratio of the constitutional units derived from the monomer having the boric acid reactive group to all constitutional units derived from the monomer having the boric acid reactive group and the other monomer is, for example, 5 mass % to 70 mass % and may be 10 mass % to 30 mass %.

The polymer compound may be of any type as long as the boric acid reactive group is contained. Examples thereof include acrylic resins such as (meth)acrylic acid, styrene-(meth)acrylic copolymers, and styrene-alkyl (meth)acrylate copolymers; and acryl-modified resins. The phrase "(meth) acryl" includes both "acryl" and "methacryl" and is used in this sense in the description below.

Acrylic resins having OH groups are first described as an example of the polymer compound.

Examples of the monomer including an OH group include 2-hydroxyethyl (meth)acrylate, 2-hydroxypropyl (meth) acrylate, 2-hydroxypentyl (meth)acrylate, phenoxyhydroxypropyl (meth)acrylate, hydroxyphenyl (meth)acrylate, hydroxybenzyl (meth)acrylate, glycerol (meth)acrylate, dihydroxyphenethyl (meth)acrylate, trimethylolpropane mono(meth)acrylate, pentaerythritol mono(meth)acrylate, 2-(hydroxyphenylcarbonyloxy)ethyl (meth)acrylate, caprolactone-modified 2-hydroxyethyl (meth)acrylate, polyethylene glycol mono(meth)acrylate, and polypropylene glycol mono(meth)acrylate. Among these, glycerol acrylate, glycerol methacrylate, 2-hydroxyethyl acrylate, 2-hydroxyethyl methacrylate, 2-hydroxypropyl acrylate, and 2-hydroxypropyl methacrylate are particularly preferable.

Examples of the other monomer include (meth)acrylic acid esters, (meth)acrylamides, vinyl esters, styrenes, (meth) acrylic acids, (meth)acrylonitrile, maleic anhydrides, and maleic acid imides.

Examples of the (meth)acrylic acid esters include methyl (meth)acrylate, ethyl (meth)acrylate, (n-, i-, sec-, or tert-) butyl (meth)acrylate, amyl (meth)acrylate, 2-ethylhexyl (meth)acrylate, dodecyl (meth)acrylate, stearyl (meth)acrylate, chloroethyl (meth)acrylate, cyclohexyl (meth)acrylate, isobornyl (meth)acrylate, dicyclopentanyl (meth)acrylate, allyl (meth)acrylate, benzyl (meth)acrylate, methoxybenzyl (meth)acrylate, chlorobenzyl (meth)acrylate, furfuryl (meth) acrylate, tetrahydrofurfuryl (meth)acrylate, phenyl (meth) acrylate, chlorophenyl (meth)acrylate, and sulfamoylphenyl (meth)acrylate.

Examples of the (meth)acrylamides include (meth) acrylamide, N-methyl (meth) acrylamide, N-ethyl (meth)acrylamide, N-propyl (meth)acrylamide, N-butyl (meth)acrylamide, N-benzyl (meth)acrylamide, N-phenyl (meth) acrylamide, N-tolyl (meth)acrylamide, N-(sulfamoylphenyl) (meth) acrylamide, N-(phenylsulfonyl) (meth)acrylamide, N-(tolylsulfonyl) (meth)acrylamide, N,N-dimethyl (meth) acrylamide, and N-methyl-N-phenyl (meth) acrylamide.

Examples of the vinyl esters include vinyl acetate, vinyl butyrate, and vinyl benzoate.

Examples of the styrenes include styrene, methylstyrene, dimethylstyrene, tirmethylstyrene, ethylstyrene, propylstyrene, cyclohexylstyrene, chloromethylstyrene, trifluoromethylstyrene, ethoxymethylstyrene, acetoxymethylstyrene, methoxystyrene, dimethoxystyrene, chlorostyrene, dichlorostyrene, bromostyrene, iodostyrene, fluorostyrene, and carboxystyrene.

The other monomer is particularly preferably a (meth) acrylic acid ester. Among the (meth)acrylic acid esters, methyl (meth)acrylate, (n-, i-, sec-, or tert-)butyl (meth)acrylate, cyclohexyl (meth)acrylate, benzyl (meth)acrylate, isobornyl (meth)acrylate, and dicyclopentanyl (meth)acrylate are particularly preferable.

The acryl-modified resins may be obtained by block copolymerization, graft copolymerization, etc.

—Method for Producing Boron Crosslinked Resin—

Examples of the method for forming a boron crosslinked resin by reacting boric acid or the like with a polymer compound having boric acid reactive group includes a method including heating and melting a polymer compound having a boric acid reactive group and a method including dissolving the polymer compound in a solvent.

A specific example of the method including heating and melting a polymer compound is a method including mixing boric acid or the like with a polymer compound having a boric acid reactive group, heating the resulting mixture into a molten state, and kneading the molten polymer compound. For example, the heating temperature may be in the range of 100° C. to 200° C., and the heating time may be in the range of 0.5 to 10 hours.

A specific example of the method including dissolving the polymer compound in a solvent is a method including dissolving a polymer compound having a boric acid reactive group in a solvent and adding boric acid or the like to the resulting solution.

The solvent may be any solvent that dissolves the polymer compound having a boric acid reactive group and may be, for example, a solvent that does not modify the polymer compound having a boric acid reactive group. Examples of the solvent include methyl ethyl ketone, acetone, and tetrahydrofuran. The amount of the solvent may be, for example, 0.5 g to 100 g relative to 1 g of the polymer compound having a boric acid reactive group. The temperature of the solvent dissolving the polymer compound having a boric acid reactive group may be in the range of, for example, 10° C. to a temperature 20° C. lower than the boiling point of the solvent.

The mass of the boric acid or the like added to 1 g of the polymer compound having the boric acid reactive group is, for example, in the range of 0.3 to 5 g or about 0.3 to about 5 g, or may be in the range of 0.5 to 2 g.

The amount of the boric acid or the like added per mole of the boric acid reactive group of the polymer compound is, for example, in the range of 0.1 to 1 mol and may be in the range of 0.3 to 0.7 mol.

—Method for Confirming Boron Crosslinked Structure—

(Method Based on Gel Component)

Whether the resin prepared as described above is a boron crosslinked resin (whether boron atoms contribute to formation of the crosslinked structure) may be confirmed by, for example, a method of measuring the amount of the gel component by using the boron crosslinked structure's tendency to dissociate with an acid as described below.

In particular, first, a weighed sample (boron crosslinked resin) is placed in an Erlenmeyer flask, 20 ml of special grade toluene at room temperature (25° C.) is poured into the flask, and the mixture is stirred for four hours at room temperature (25° C.) and kept in a refrigerator (0° C.) overnight (12 hours). The mixture is then placed in a centrifuge tube of a centrifugal separator and centrifugally separated for 20 minutes at a speed of 12,000 revolutions per hour. The centrifuge tube after centrifugal separation is left standing at room temperature (25° C.) for 1.5 hours. Then the lid of the centrifugal tube is opened and the supernatant is taken out with a micropipette.

The insoluble precipitate is dried and obtained as a gel component.

The gel component is subjected to an acid treatment. In particular, 1 g of the gel component obtained is added to an acid, which is an acidic solution containing 10 ml of water and 1 ml of 0.3 mol/L nitric acid. The mixture is stirred for 1 hour at room temperature (25° C.). Then the gel component is separated by filtration or the like, taken out from the container, and dried at room temperature.

Upon completion of the acid treatment described above, 20 ml of special grade toluene at room temperature (25° C.) is poured into the flask, and the mixture is stirred for four hours at room temperature (25° C.) and kept in a refrigerator (0° C.) overnight (12 hours). The mixture is then placed in a centrifuge tube of a centrifugal separator and centrifugally separated for 20 minutes at a speed of 12,000 revolutions per hour. The centrifuge tube after centrifugal separation is left standing at room temperature (25° C.) for 1.5 hours. The lid of the centrifugal tube is opened, and 2.5 ml of supernatant is taken with a micropipette and placed in an aluminum dish separately weighed. The toluene component is evaporated by using a hot plate. The aluminum dish is vacuum-dried for 8 hours. The weight of the aluminum dish after vacuum drying is measured and the content of the gel component having the boron crosslinked structure is calculated by the following equation:

$$\text{Content of gel having boron crosslinked structure } (\%) = \{(B' - C') \times 8\} / A' \times 100$$

A': mass of sample [g]

B': total mass of toluene solubles and aluminum dish [g]

C': mass of aluminum dish only [g]

Whether the carrier contains a boron crosslinked resin is determined by using the carrier as a sample and confirming the presence of a gel component having a boron crosslinked structure by the aforementioned method (method using the boron crosslinked structure's tendency to dissociate with an acid).

(Confirmation Through $^1$H-NMR Analysis)

Another method for confirming that the coating layer prepared as above is a boron crosslinked resin is a method that uses $^1$H-NMR analysis, as described below.

For example, a $^1$H-NMR spectrum before formation of the boron crosslinked structure and a $^1$H-NMR spectrum after formation of the boron crosslinked structure (in other words, the boron crosslinked resin formed on the surfaces of the core particles) are measured. Then how a chemical shift value attributable to a hydrogen atom bonded to a carbon atom directly bonding to a boron reactive group in the boron reactive group-containing polymer compound (or a monomer containing a boron reactive group) before formation of the boron crosslinked structure changes as a result of the formation of the boron crosslinked structure is investigated to confirm whether or not the boron crosslinked structure is formed.

An example in which a boron crosslinked structure is formed as a result of a reaction between trimethyl borate and a hydroxyl group, i.e., a boron reactive group, of glycerin monomethacrylate is described below as an example in which a boron crosslinked structure is formed.

The $^{1}$H-NMR spectrum of glycerin monomethacrylate (GLM) is compared with the $^{1}$H-NMR spectrum of the reaction product between GLM and trimethyl borate. As described below, the peak attributable to the 2-position proton of GLM is shifted from 3.94 ppm to 3.69 ppm and the peak attributable to the 3-position proton of GLM is shifted from 3.49 ppm to 3.24 ppm. The boron crosslinked structure is confirmed by comparing the $^{1}$H-NMR spectrum of the raw material, i.e., the monomer having a boron reactive group, and the $^{1}$H-NMR spectrum of the obtained toner particles by utilizing this tendency.

Alternatively, an acid treatment (described above in the section "Method based on gel component") of the boron crosslinked resin may be conducted while performing $^{1}$H-NMR analysis before and after the acid treatment. The boron crosslinked structure is confirmed from the difference in the chemical shift value.

[Chem. 1]

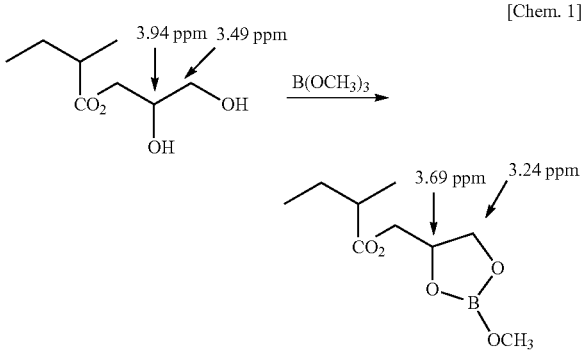

The temperature at which the boron crosslinked structure in the boron crosslinked resin obtained by the method described above dissociates is, for example, in the range of 100° C. to 160° C.

<Coating Layer>

The coating layer of the carrier at least contains the boron crosslinked resin, as discussed above. If needed, other components such as other resins and inorganic particles may be contained in addition.

—Other Resins—

Examples of other resins include polyolefin resins such as polyethylene and polypropylene; polyvinyl or polyvinylidene resins such as polystyrene, acrylic resin, polyacrylonitrile, polyvinyl acetate, polyvinyl alcohol, polyvinyl butyral, polyvinyl chloride, polyvinyl carbazole, polyvinyl ether, and polyvinyl ketone; vinyl chloride-vinyl acetate copolymers; styrene-acrylic acid copolymers; straight silicone resins having organosiloxane bonds and modified products thereof; fluorine resins such as polytetrafluoroethylene, polyvinyl fluoride, polyvinylidene fluoride, and polychlorotrifluoroethylene; polyesters; polyurethanes; polycarbonates; phenolic resins; amino resins such as urea-formaldehyde resins, melamine resins, benzoguanamine resins, urea resins, and polyamide resins; and epoxy resins. Any other resins may also be used.

When the coating layer contains other resins, the ratio of the boron crosslinked resin to the total of the boron crosslinked resin and other resins is, for example, 30 mass % to 90 mass % and may be 40 mass % to 70 mass %.

—Inorganic Particles—

The coating layer may contain inorganic particles to obtain high-quality image and adjust electrical resistance. The inorganic particle content is, for example, 3 to 30 mass % and may be 5 to 20 mass % relative to the entire coating layer.

Examples of the inorganic particles include metals such as gold, silver, copper; carbon black; semiconductive oxides such as titanium oxide and zinc oxide; and titanium oxide, zinc oxide, barium sulfate, aluminum borate, or potassium titanate particles having surfaces coated with tin oxide, carbon black, or a metal. Of these, carbon black having high electrical conductivity (e.g., carbon black having a volume resistivity within the range described below) may be used as the inorganic particles.

The volume resistivity of the inorganic particles is, for example, in the range of $10^{-4}$ Ω·cm to $10^{9}$ Ω·cm. The volume-average particle size of the inorganic particles is, for example, in the range of 0.005 μm to 0.5 μm.

—Other Components—

The coating layer may contain other components in addition to the components described above. Examples of other components include a charge control agent, a nitrogen-containing resin, and other particles.

<Core Particles>

The core particles are not particularly limited and any available particles used as core particles of carriers may be used. For example, magnetic particles may be used as core particles or resin particles containing magnetic particles dispersed in the resin may be used as the core particles.

Examples of the magnetic material contained in the magnetic particles include magnetic metals such as iron, steel, nickel, and cobalt; alloys of magnetic metals and manganese, chromium, and rare earth metals; and magnetic oxides such as ferrite and magnetite.

The magnetic particles used as the core particles are formed by granulation and sintering. The magnetic material may be pulverized as a pre-treatment. The method of pulverization is not particularly limited and any available pulverization method may be employed. For example, a mortar, a ball mill, a jet mill, or the like may be employed.

The sintering temperature may be lower than the temperature usually employed and differs depending on the material used. The sintering temperature is, for example, 500° C. to 1200° C. and may be 600° C. to 1000° C. The sintering temperature may be kept low by performing stepwise calcining during the sintering step, for example. In such a case, the length of time taken for sintering as a whole may be extended.

When the resin particles containing dispersed magnetic particles are used as the core particles, the magnetic particle content in the core particles is, for example, 80 mass % to 99 mass % and may be 95 mass % to 99 mass %.

The volume-average particle size of the magnetic particles contained in resin particles is, for example, 0.05 μm to 5.0 μm and may be 0.1 μm to 1.0 μm. The volume-average particle size is measured by laser diffraction/scattering particle size distribution analyzer.

The magnetic particles contained in the resin particles may be prepared by, for example, applying mechanical shear force to particles of the magnetic material mentioned above. If needed, a coupling agent may be used as a surface modifier.

The resin used in the resin particles containing dispersed magnetic particles is not particularly limited. Examples thereof include styrene resins, acrylic resins, phenolic resins, melamine resins, epoxy resins, urethane resins, polyester resins, and silicone resins. The boron crosslinked resin described above may also be used.

A charge control agent, a fluorine-containing particles, and other components may also be added to the resin particles containing dispersed magnetic particles depending on the need.

Examples of the method for preparing resin particles containing dispersed magnetic particles include a melt kneading method that uses a Banbury mixer or a kneader, a suspension polymerization method, and a spray drying method.

The volume-average particle size of the core particles is, for example, 10 μm to 500 μm, may be 20 μm to 100 μm or 25 μm to 60 μm.

As for the magnetic force of the core particles, the saturation magnetization at 3000 oersted is 50 emu/g or more or may be 60 emu/g or more.

The instrument used for measuring the magnetic force of the core particles is a vibrating sample magnetometer, VSMP10-15 produced by Toei Industry Co., Ltd. A measurement sample is placed in a cell having an inner diameter of 7 mm and a height of 5 mm and loaded in the magnetometer. The measurement is conducted by applying a magnetic field while sweeping up to a maximum of 3000 oersted. Then the applied magnetic field is decreased to form a hysteresis curve on a recording sheet. The saturation magnetization, the residual magnetization, and the coercive force are determined from the curve. The saturation magnetization of the core particles is the magnetization measured in a 3000 oersted magnetic field.

The volume resistivity of the core particles is, for example, $10^5$ Ω·cm to $10^{9.5}$ Ω·cm and may be $10^7$ Ω·cm to $10^9$ Ω·cm.

The volume resistivity (Ω·cm) of the core particles is measured as follows. The temperature and relative humidity of the measurement environment are 20° C. and 50%, respectively. An object to be measured is placed flat on a surface of a circular jig having a 20 $cm^2$ electrode plate so that the object to be measured forms a layer having a thickness of 1 to 3 mm. Another 20 $cm^2$ electrode plate is placed on the layer to sandwich the layer. In order to eliminate gaps between the electrode plates and the object, a load of 4 kg is applied on the electrode plate on the layer and the thickness of the layer (cm) is measured. The electrodes under and above the layer are connected to an electrometer and a high-voltage power supply. A high voltage is applied to the electrodes so that the electric field is 103.8 V/cm, and the current value (A) that flows at this time is read to calculate the volume resistivity (Ω·cm) of the object. The formula for calculating the volume resistivity (Ω·cm) of the object is as follows:

$$R=E\times 20/(I-I_0)/L \qquad \text{Formula}$$

In the formula, R represents the volume resistivity (Ω·cm) of the object to be measured, E represents the applied voltage (V), I represents a current value (A), $I_0$ represents a current value (A) at zero application voltage, and L represents the thickness (cm) of the layer. The coefficient 20 is the area ($cm^2$) of the electrode plate.

<Method for Forming Coating Layer (Coating Step)>

Examples of the method for forming a coating layer on a surface of a core particle include a wet coating method and a dry coating method.

Examples of the wet coating method include a dipping method of dipping core particles in a solution for forming a coating layer, a spraying method of spraying a solution for forming a coating layer onto surfaces of core particles, a fluid bed method of spraying a coating layer-forming solution while having the core particles are made to float on a bed of air, and a kneader coater method of mixing core particles and a solution for forming a coating in a kneader coater and removing the solvent.

Examples of the dry coating method include a method for forming a coating layer by heating a mixture of core particles and a coating layer-forming material in a dry state. In particular, for example, core particles and a coating layer-forming material are mixed in a gas phase without using a solvent and the resulting mixture is melted by heating to form a coating layer.

When a dry coating method is employed to add inorganic particles to the coating layer, the step of dispersing inorganic particles in a solvent, i.e., the step which is needed in a wet coating method that uses a solution for forming a coating layer, is omitted. This is because the inorganic particles easily disperse in a resin by heating and mechanical shear. Moreover, since no solvent is used, the limitation as to the solubility of the resin that forms the coating layer in a solvent is not imposed. For example, a resin barely soluble in a solvent may be used. Since two or more types of resins do not mix and melt with each other in a dry coating method, separate functions may be assigned in the direction of the thickness of the coating layer. For example, it becomes easier to form both a surface for controlling the resistance and a surface for controlling charging.

In a dry coating method, for example, the resin for coating is melted by heating or application of mechanical shear to form a coating layer on surfaces of the core particles. Although a boron crosslinked resin exhibits high hardness and high strength at a temperature of 40° C. or less since the boron crosslinked structure is maintained, it easily loses the crosslinked structure, melts, and becomes less viscous at a temperature of 150° C. or more by heating. Thus, a good coating layer is formed by a dry coating method.

The coverage, i.e., the ratio of the core particle surface covered with a coating layer, is, for example 80% or more, 90% or more, or 100%. When the coverage is 80% or more, charge injection to the carrier is suppressed over a prolonged period. This suppresses generation of white spots on an image caused by the charge-injected carriers migrating to a latent image-carrying member.

The coverage of the coating layer is determined by X-ray photoelectron spectroscopy (XPS). XPS analyzer JPS 80 produced by JEOL is used in XPS, and a MgKα line is used as the X-ray source. The acceleration voltage is set to 10 kV and the emission current is set to 20 mV to analyze elements (typically carbon) that are main constituents of the coating layer and elements (e.g., iron and oxygen when the core particles are composed of an iron oxide material such as magnetite) that are main constituents of the core particles.

In the description below, the core particles are assumed to be iron oxide-based core particles. A C1s spectrum is measured for carbon, an Fe2p3/2 spectrum is measured for iron, and an O1s spectrum is measured for oxygen. The numbers of atoms of carbon, oxygen, and iron (represented by AC, AO, and AFe, respectively) are determined on the basis of the spectra. The iron content in the core particles alone and the iron content in the core particles (carrier) coated with coating layers are determined from equation (2) below by using the determined carbon, oxygen, and iron ratios on an atom number basis. Then the coverage is determined from equation (3) below.

$$\text{Iron content (atomic \%)}=AFe/(AC+AO+AFe)\times 100 \quad \text{Equation (2)}$$

$$\text{Coverage (\%)}=\{1-(\text{iron content in carrier})/(\text{iron content in core particles alone})\}\times 100 \quad \text{Equation (3)}$$

When a material other than iron oxide-based materials is used in the core particles, the spectrum of the metal element constituting the core particles other than oxygen is measured and the same calculations are performed according to equations (2) and (3) above to determine the coverage.

The average thickness of the coating layer is, for example 0.1 μm to 10 μm, or may be 0.1 μm to 3.0 μm or 0.1 μm to 1.0 μm.

The average thickness (μm) of the coating layer is determined from equation (4):

$$\text{Average thickness (μm)}=[\text{amount of coating resin (including all additives such as conductive powder) per carrier particle/surface area per carrier particle}]/\text{average specific gravity of the coating layer}=\{[\tfrac{4}{3}\pi\cdot(d/2)^3\cdot\rho\cdot WC]/[4\pi\cdot(d/2)^2]\}/\rho C=(\tfrac{1}{6})\cdot(d\cdot\rho\cdot wC/\rho C) \quad \text{Equation (4)}$$

where ρ (dimensionless) represents the absolute specific gravity of the core particle, d (μm) represents the volume-average particle size of the core particle, ρC represents the average specific gravity of the coating layer, and WC (parts by mass) represents the total content of the coating layer per part by mass of the core particle.

<Physical Properties of Carrier>

The number-average particle size of the carrier is, for example, 15 μm to 50 μm or may be 20 μm to 40 μm. The number-average particle size of the carrier is determined by measuring the maximum dimension of each particle from a scanning electron microscopy (SEM) image taken with an electron microscope and averaging the particle sizes of 100 particles.

The shape factor SF1 of the carrier is, for example, 120 to 145. The shape factor SF1 of the carrier is determined by equation (5) below:

$$SF1=100\pi\times(ML)^2/(4\times A) \quad \text{Equation (5)}$$

where ML represents the maximum length of the carrier particle and A represents a projection area of the carrier particle. The maximum length and the projection area of the carrier particles are determined by observing sampled carrier particles on a slide glass with an optical microscope, inputting the image captured by a video camera into an image analyzer (LUZEX III produced by Nireco Corporation), and conducting image analysis. The number of particles sampled is 100 or more and the average particle size of 100 or more particles is used in determining the shape factor according to equation (5).

The saturation magnetization of the carrier is, for example, 40 emu/g or more and may be 50 emu/g or more.

The saturation magnetization is measured with a vibrating sample magnetometer, VSMP10-15 (produced by Toei Industry Co., Ltd.). A measurement sample is placed in a cell having an inner diameter of 7 mm and a height of 5 mm and loaded in the magnetometer. The measurement is conducted by applying a magnetic field while sweeping up to a maximum of 1000 oersted. Then the applied magnetic field is decreased to form a hysteresis curve on a recording sheet. The saturation magnetization, the residual magnetization, and the coercive force are determined from the curve. The saturation magnetization of the carrier is the magnetization measured in a 1000 oersted magnetic field.

The volume resistivity (25° C.) of the carrier is, for example, in the range of $1\times10^7$ Ω·cm to $1\times10^{15}$ Ω·cm, or may be in the range of $1\times10^8$ Ω·cm to $1\times10^{14}$ Ω·cm or in the range of $1\times10^8$ Ω·cm to $1\times10^{13}$ Ω·cm.

The volume resistivity of the carrier is measured as with the volume resistivity of the core particles.

The flaking ratio is assumed to be the strength of the carrier coating layer. The flaking ratio of the carrier of the exemplary embodiment is, for example, in the range of 6 wt % to 12 wt %.

The flaking ratio is determined by placing 30 g of the carrier in a sample mill used as a mixer or a pulverizer, stirring the carrier for 30 seconds at 13,000 rpm ten times, and determining the amount of the coating layers that have detached. In particular, after the stirring, 10 g of the carrier is recovered, placed in a glass beaker, washed with an aqueous triton solution while restricting the carrier particles with a magnet, and dried to determined the mass (A).

The mass of the coating layer is determined by heating the sample to 500° C. in a thermogravimetric analyzer (TGA) and determining the decrease in mass (B).

$$\text{Flaking ratio (wt \%)}=\{(10-A)/B\}\times 100$$

[Electrostatic Image Developer]

The electrostatic image developer of the exemplary embodiment (hereinafter also referred to as "developer") at least includes a toner and a carrier. This carrier is the same carrier as one described above.

The toner is not particularly limited and any toner may be used. A typical example of the toner is a color toner containing a binder resin and a colorant. An infrared-absorbing toner that uses an infrared absorbent instead of the colorant may be used instead. In addition to these components, a releasing agent and various internal additives, external additives, and other components may be further added if needed. From the viewpoint of suppressing fogging, the electrical resistance of the binder resin may be high. Thus, a resin having a low water content or free of crystal structures may be used.

Examples of the binder resin include homopolymers and copolymers, e.g., monoolefins such as ethylene, propylene, butylene, and isoprene; vinyl esters such as vinyl acetate, vinyl propionate, vinyl benzoate, and vinyl butyrate; α-methylene fatty monocarboxylic acid esters such as methyl acrylate, phenyl acrylate, octyl acrylate, methyl methacrylate, ethyl methacrylate, butyl methacrylate, and dodecyl methacrylate; vinyl ethers such as vinyl methyl ether, vinyl ethyl ether, and vinyl butyl ether; and vinyl ketones such as vinyl methyl ketone, vinyl hexyl ketone, and vinyl isopropenyl ketone. Representative examples of the binder resin among these include polystyrene, styrene-alkyl acrylate copolymer, styrene-butadiene copolymer, styrene-maleic anhydride copolymer, and polypropylene. Other examples of the binder resin include polyesters, polyurethanes, epoxy resins, silicone resins, polyamides, and modified rosins.

The colorant is not particularly limited. Examples thereof include carbon black, aniline blue, Calco Oil blue, chrome yellow, ultramarine blue, Du Pont oil red, quinoline yellow, methylene blue chloride, phthalocyanine blue, malachite green oxalate, lamp black, rose bengal, C. I. Pigment Red 48:1, C. I. Pigment Red 122, C. I. Pigment Red 57:1, C. I. Pigment Yellow 97, C. I. Pigment Yellow 12, C. I. Pigment Blue 15:1, and C. I. Pigment Blue 15:3.

The toner may include a charge control agent, if needed. When the toner particles are used in a color toner, a colorless or light-colored charge control agent that does not affect the color tone may be used. A known charge control agent may be used. Examples thereof include azo-based metal complexes and metal complexes and metal salts of salicylic acid or alkyl salicylic acid.

The toner may contain a releasing agent to prevent offset or the like, if needed.

Examples of the releasing agent include paraffin wax and derivatives thereof, montan wax and derivatives thereof, microcrystalline wax and derivatives thereof, Fischer-Tropsch wax and derivatives thereof, and polyolefin wax and derivatives thereof. The "derivatives" include oxides, polymers with vinyl monomers, and graft-modified compounds. Other examples of the releasing agent include alcohols, fatty acids, vegetable wax, animal wax, mineral wax, ester wax, and acid amides.

The toner may contain inorganic oxide particles inside. Examples of the inorganic oxide particles include $SiO_2$, $TiO_2$, $Al_2O_3$, CuO, ZnO, $SnO_2$, $CeO_2$, $Fe_2O_3$, MgO, BaO, CaO, K2O, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$. Of these, silica particles and titania particles are particularly preferable as the inorganic oxide particles. The surface of the inorganic oxide particles may or may not be hydrophobized in advance.

The hydrophobing treatment is performed by dipping an inorganic oxide in a hydrophobing agent, for example. The hydrophobing agent is not particularly limited. Examples thereof include silane coupling agents, silicone oil, titanate coupling agents, and aluminum coupling agents. These may be used alone or in combination. Among these, silane coupling agents are preferred.

The amount of the hydrophobing agent differs depending on the type of the inorganic oxide particles and is not defined. For example, 5 to 50 parts by mass of the hydrophobing agent may be used per 100 parts by mass of the inorganic oxide particles.

Inorganic oxide particles may be added to the surfaces of the toner. Examples of the inorganic oxide particles added to the toner surface are the same as those of the inorganic oxide particles added inside the toner described above.

As for the particle size distribution of the toner particles, the toner particles having a particle size 3 μm or less may account for 6% to 25% or 6% to 16% of the total number of the toner particles on a particle number basis. The toner particles having a particle size 16 μm or more may account for 1.0 vol. % or less, for example.

The volume-average particle size of the toner is, for example 3.5 μm to 9 μm.

The particle size distribution and volume-average particle size of the toner particles are determined with Coulter multisizer II (produced by Beckman Coulter) and an electrolyte, ISOTON-II (produced by Beckman Coulter). The measured particle size distribution is plotted versus divided particle size ranges (channels) to draw a cumulative distribution for the volume from a small size side. The particle size at which 50% accumulation is given is defined as the volume-average particle size.

The toner may be prepared by a typical process, such as a kneading and pulverizing method or a wet granulation method. Examples of the wet granulation method include a suspension polymerization method, an emulsion polymerization method, an emulsion polymerization/aggregation method, a soap-free emulsion polymerization method, a non-aqueous dispersion polymerization method, an in-situ polymerization method, an interfacial polymerization method, an emulsion dispersion granulation method, and an aggregation/coalescence method.

When a kneading and pulverizing method is employed to prepare a toner, for example, a binder resin and, if needed, a colorant and other additives are mixed in a mixer such as a Henschel mixer or a ball mill, and the mixture is melt-kneaded with a thermal kneader such as hot rollers, a kneader, or an extruder so that the resins are compatibilized with each other. Thereto, an infrared absorber, an antioxidant, etc., are dispersed or dissolved as needed, and the mixture is solidified by cooling, pulverized, and classified to obtain core particles.

The shape factor of the toner particles prepared by a wet granulation method is, for example, in the range of 110 to 135. The shape factor of the toner particles is determined as with the shape factor SF1 of the carrier.

The ratio of the mass of the toner to the mass of the carrier is, for example, 0.01 to 0.3 and may be 0.03 to 0.2.

The developer of the exemplary embodiment may be used as a developer to be accommodated in a developing device in advance. Alternatively, for example, the developer may be used as a replenishing developer used in a so-called trickle development system in which a carrier is also added along with the toner to compensate for the toner consumed by development and the carrier inside the developing device is replaced gradually so as to suppress changes in charge amount and stabilize the image density. When the developer of the exemplary embodiment is used as a replenishing developer for the trickle development system, the mass mixing ratio of the toner to the carrier is 2 or more, may be 3 or more, or may be 5 or more.

[Image Forming Apparatus]

An image forming apparatus according to an exemplary embodiment using the electrostatic image-developing toner of the exemplary embodiment is described below.

The image forming apparatus of the exemplary embodiment includes an image-carrying member; a charging unit that charges a surface of the image-carrying member; an electrostatic image-forming unit that forms an electrostatic image on the charged surface of the image-carrying member; a developing unit that develops the electrostatic image on the surface of the image-carrying member with the electrostatic image developer of the exemplary embodiment to form a toner image; a transfer unit that transfers the toner image on the surface of the image-carrying member onto a surface of a receiving member; and a fixing unit that fixes the toner image transferred onto the surface of the receiving member.

The developing unit includes a developer-carrying member that carries the electrostatic image developer, as described above. The difference in speed between the surface of the image-carrying member and the surface of the developer-carrying member in terms of the ratio of the rotating speed of the surface of the image-carrying member to the rotating speed of the surface of the developer-carrying member is, for example, 1:1.5 or more and 1:5 or less or about 1:1.5 or more and about 1:5 or less.

The developer-carrying member may be a cylindrical member that supplies a toner to the surface of the image-carrying member while rotating.

The velocity of the surface of the developer-carrying member is, for example, 400 mm/s or more and may be 450 mm/s or more. The velocity of the surface of the developer-carrying member may be 1500 mm/s or less, or 1200 mm/s or less.

The developing unit may include, for example, a developer housing container for housing a developer; a developer supplying unit that supplies a replenishing developer to the developer housing container; and a developer discharging unit that discharges at least part of the developer accommodated in the developer housing container. In other words, the developing unit may employ a trickle development system.

The mixing ratio of the toner to the carrier in the replenishing developer is, for example, mass of toner/mass of carrier≥2, mass of toner/mass of carrier≥3, or mass of toner/mass of carrier≥5.

The image forming apparatus of the exemplary embodiment may further include a cleaning unit including a cleaning blade or the like, a charge erasing unit, etc., in addition to the aforementioned units.

A portion that includes the developing unit of the image forming apparatus of the exemplary embodiment may be configured as a cartridge (process cartridge) removably attachable to the main body of the image forming apparatus.

A non-limiting example of the image forming apparatus of the exemplary embodiment is described below. Only the relevant components are described.

FIG. 1 is a schematic diagram showing a color image forming apparatus of a four-drum tandem system. The image forming apparatus shown in FIG. 1 includes first to fourth electrophotographic image forming units 10Y, 10M, 10C, and 10K that respectively output yellow (Y), magenta (M), cyan (C), and black (K) images on the basis of color-separated image data. The image forming units (may be referred to as "units" hereinafter) 10Y, 10M, 10C, and 10K are arranged side-by-side in the horizontal direction at predetermined intervals. The units 10Y, 10M, 10C, and 10K may be configured as a process cartridge removably attached to the main body of the image forming apparatus.

An intermediate transfer belt 20 that functions as an intermediate transfer member is disposed above the units 10Y, 10M, 10C, and 10K in the drawing. The intermediate transfer belt 20 is stretched over a driving roller 22 and a support roller 24 in contact with the inner surface of the intermediate transfer belt. The driving roller 22 and the support roller 24 are apart from each other in the direction that extends from the left side of the drawing to the right side of the drawing. The intermediate transfer belt is configured to run in the direction from the first unit 10Y to the fourth unit 10K. Force is applied to the support roller 24 with a spring or the like not shown in the drawing in the direction away from the driving roller 22 so that tension is applied to the intermediate transfer belt 20 stretched over the two rollers. An intermediate transfer member cleaning device 30 opposing the driving roller 22 is provided on the image-carrying member-side of the intermediate transfer belt 20.

Yellow, magenta, cyan, and black toners in toner cartridges BY, 8M, 8C, and 8K are respectively supplied to developing units 4Y, 4M, 4C, and 4K of the units 10Y, 10M, 10C, and 10K.

Since the first to fourth units 10Y, 10M, 10C, and 10K have identical structures, the first unit 10Y configured to form a yellow image and disposed on the upstream side in the intermediate transfer belt running direction is described as a representative example. The descriptions of the second to fourth units 10M, 10C, and 10K are omitted by giving reference numerals having magenta (M), cyan (C), and black (K) attached to the numerals.

The first unit 10Y includes a photoconductor 1Y as an image-carrying member. A charging roller 2Y (charging unit) that charges the surface of the photoconductor 1Y to a predetermined potential, an exposing device 3 (electrostatic image forming unit) that forms an electrostatic image by exposing the charged surface with a laser beam 3Y on the basis of a color-separated image signal, a developing device 4Y (developing unit) that develops the electrostatic image by supplying a charged toner to the electrostatic image, a primary transfer roller 5Y that transfers the developed toner image onto the intermediate transfer belt 20, and a photoconductor cleaning device 6Y that removes the toner remaining on the surface of the photoconductor 1Y after the primary transfer are provided around the photoconductor 1Y. The electrostatic image forming unit includes the charging roller 2Y and the exposing device 3. The transfer unit includes the primary transfer roller 5Y, the intermediate transfer belt 20, and a secondary transfer roller 26 described below.

The primary transfer roller 5Y is disposed in the inner side of the intermediate transfer belt 20 and opposes the photoconductor 1Y. Bias power supplies (not shown in the drawing) that apply a primary transfer bias are respectively connected to the primary transfer rollers 5Y, 5M, 5C, and 5K. The bias power supplies change the transfer bias applied to the primary transfer rollers by being controlled by a controller not shown in the drawing.

Operation of forming a yellow image by using the first unit 10Y will now be described. Prior to operation, the surface of the photoconductor 1Y is charged to a potential of about −600 V to about −800 V by using the charging roller 2Y.

The photoconductor 1Y is formed by layering a photosensitive layer on an electrically conductive (volume resistivity at 20° C.: $1\times10^{-6}$ Ω·cm or less) base. The photosensitive layer normally has a high resistivity (a resistivity of common resin) but when irradiated with the laser beam 3Y, the resistivity of the portion irradiated with the laser beam changes. The laser beam 3Y is output to the charged surface of the photoconductor 1Y through the exposing device 3 in accordance with the yellow image data transmitted from the controller (not shown). The laser beam 3Y hits the photosensitive layer on the surface of the photoconductor 1Y and an electrostatic image of a yellow print pattern is thereby formed on the surface of the photoconductor 1Y.

An electrostatic image is an image formed on the surface of the photoconductor 1Y by charging. A portion of the photosensitive layer irradiated with the laser bean 3Y exhibits a lower resistivity and thus the charges in that portion flow out while charges remain in the rest of the photosensitive layer not irradiated with the laser beam 3Y. Since the electrostatic image is formed by such residual charges, it is a negative latent image.

The electrostatic image formed on the photoconductor 1Y is rotated to a predetermined developing position as the photoconductor 1Y is run. The electrostatic image on the photoconductor 1Y is visualized (developed) with the developing device 4Y at this developing position.

An electrostatic image developer containing at least a yellow toner is accommodated in the developing device 4Y. The yellow toner is frictionally charged as it is stirred in the developing device 4Y and carried on the developer roller (developer-carrying member) by having charges having the same polarity (negative) as the charges on the photoconductor 1Y. As the surface of the photoconductor 1Y pass by the developing device 4Y, the yellow toner electrostatically adheres on the latent image portion on the photoconductor 1Y from which charges are erased and the latent image is thereby developed with the yellow toner.

From the standpoints of development efficiency, image graininess, and tone reproducibility, a bias potential (development bias) formed by superimposing AC components to DC components may be applied to the developer-carrying member. In particular, when the DC voltage Vdc applied to the developer-carrying member is in the range of −300 to −700, the AC voltage peak width Vp-p for the developer-carrying member may be set within the range of 0.5 to 2.0 kV.

The photoconductor 1Y on which the yellow toner image is formed is continuously moved at a predetermined velocity to transport the developed toner image on the photoconductor 1Y to a predetermined primary transfer position.

After the yellow toner image on the photoconductor 1Y is transported to the primary transfer position, a primary transfer bias is applied to the primary transfer roller 5Y. Electrostatic force working from the photoconductor 1Y toward the primary transfer roller 5Y also works on the toner image and the toner image on the photoconductor 1Y is transferred onto the intermediate transfer belt 20. The transfer bias applied at this time has a polarity opposite to that (negative) of the toner, i.e., the polarity of the transfer bias is positive. For example, the transfer bias for the first unit 10Y is controlled to about +10 μA by the controller (not shown).

The toner remaining on the photoconductor 1Y is removed by the cleaning device 6Y and recovered.

The primary transfer bias applied to the primary transfer rollers 5M, 5C, and 5K of the second to fourth units 10M to 10K are also controlled as with the first unit.

The intermediate transfer belt 20 onto which the yellow toner image has been transferred by using the first unit 10Y is transported through the second to fourth units 10M, 10C, and 10K. Toner images of other colors are superimposed on the yellow toner image to achieve multiple transfer.

The intermediate transfer belt 20 onto which the toner images of four colors are transferred using the first to fourth units then reaches a secondary transfer section constituted by the intermediate transfer belt 20, the support roller 24 in contact with the intermediate transfer belt inner surface, and the secondary transfer roller 26 disposed on the image-carrying surface side of the intermediate transfer belt 20. Meanwhile, a recording sheet P (receiving member) is supplied at a predetermined timing from a feeding mechanism to a space where the secondary transfer roller 26 and the intermediate transfer belt 20 contact each other, and a secondary transfer bias is applied to the support roller 24. The transfer bias applied has the same polarity as the toner (negative). The electrostatic force from the intermediate transfer belt 20 toward the recording sheet P works on the toner image, and the toner image on the intermediate transfer belt 20 is transferred onto the recording sheet P. The secondary transfer bias is determined by the resistance of the second transfer section detected with a resistance detector (not shown) and is controlled by voltage.

Subsequently, the recording sheet P is sent to the contact portion between a pair of fixing rollers in the fixing device 28 (fixing unit). The superimposed toner images are thermally melted and fixed on the recording sheet P.

Examples of the receiving member onto which the toner images are transferred include regular paper used in electrophotographic system copiers and printers and OHP sheets.

The recording sheet P upon completion of the fixing of the color image is transported toward the discharging unit to terminate a series of color image forming operations.

Although the image forming apparatus has a structure in which toner images are transferred onto the recording sheet P by using the intermediate transfer belt 20, the structure is not limited to this. Alternatively, toner images may be directly transferred from the photoconductor onto the recording sheet.

According to the image forming apparatus of this exemplary embodiment, the toner of the exemplary embodiment is accommodated in the toner cartridge. The developer that contains a toner and the carrier according to the exemplary embodiment is accommodated in the developing device.

[Process Cartridge and Developer Cartridge]

Figure 2:
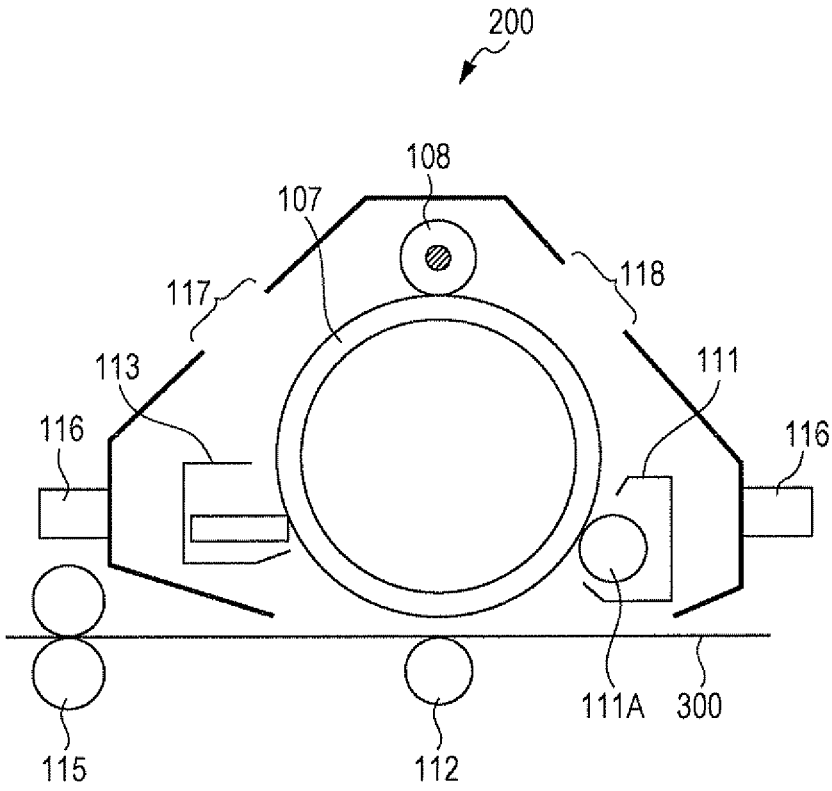
FIG. 2 is a schematic diagram showing an example of a process cartridge according to an exemplary embodiment.

FIG. 2 is schematic diagram showing an exemplary embodiment of a process cartridge accommodating the electrostatic image developer of the exemplary embodiment. A process cartridge 200 includes a developing device 111 having a developer carrying member 111A, a photoconductor 107, a charging roller 108, a photoconductor cleaning device 113, an opening 118 for exposure, and an opening 117 for charge erasing by exposure which are assembled using an assembling rail 116. In FIG. 2, reference numeral 300 denotes a receiving member.

The process cartridge 200 is removably attachable to the image forming apparatus main body that includes a transfer device 112, a fixing device 115, and other components (not shown in the drawing), and constitutes part of the image forming apparatus together with the image forming apparatus main body.

The process cartridge 200 shown in FIG. 2 has the photoconductor 107, the charging roller 108, the developing device 111, the photoconductor cleaning device 113, the opening 118 for exposure, and the opening 117 for charge erasing by exposure. These devices may be selectively combined. The process cartridge of this exemplary embodiment may include the developing device 111 and at least one selected from the group consisting of the photoconductor 107, the charging roller 108, the photoconductor cleaning device 113, the opening 118 for exposure, and the opening 117 for charge erasing by exposure.

A developer cartridge according to an exemplary embodiment is described below. The developer cartridge of the exemplary embodiment is removably attached to an image forming apparatus and at least contains a developer to be supplied to the developing unit in the image forming apparatus. This developer is the electrostatic image developer of the exemplary embodiment described above.

The developer cartridge may be a cartridge that directly accommodates a developer containing a toner and a carrier or a cartridge constituted by a cartridge that accommodates a toner and a cartridge that accommodates a carrier.

When a developer cartridge accommodating the electrostatic image developer of the exemplary embodiment is used in an image forming apparatus of a type in which a developer cartridge is removably attached, the electrostatic image developer of the exemplary embodiment is easily supplied to the developing device.

In the exemplary embodiment, a photoconductor is used as the image-carrying member. Alternatively, a dielectric recording member may be used as the image-carrying member, for example.

When an electrophotographic photoconductor is used as the image-carrying member, the charging unit may be, for example, a corotron charger, a contact charger, or the like. The transfer unit may include a corotron charger.

[Image Forming Method]

An image forming method of the exemplary embodiment at least includes a charging step of charging a surface of an image-carrying member; a latent image-forming step of forming an electrostatic latent image on the charged surface of the image-carrying member; a developing step of developing the electrostatic latent image on the surface of the image-carrying member with a developer to form a toner image; a transfer step of transferring the toner image on the surface of the image-carrying member onto a surface of a receiving member; and a fixing step of fixing the toner image transferred onto the surface of the receiving member. A developer that contains the electrostatic image developing toner of the aforementioned exemplary embodiment is used as the developer.

The image forming method may include steps other than the steps described above, if needed. Examples of such steps include a toner removing step of removing the toner remaining on the image-carrying body surface after the transfer step. The transfer step may be a step of transferring a toner image from the image-carrying member onto a receiving member via an intermediate transfer member (intermediate transfer system).

In the developing step, for example, the difference in speed between the surface of the image-carrying member and the surface of the developer-carrying member in terms of the ratio of the rotating speed of the surface of the image-carrying member to the rotating speed of the surface of the developer-carrying member may be, for example, in the range of 1:1.5 or more and 1:5 or less or about 1:1.5 or more and about 1:5 or less.

EXAMPLES

The exemplary embodiments will now be described in further detail by using Examples and Comparative Examples which do not limit the scope of the exemplary embodiments. Note that "parts" means "parts by mass" and "%" means "mass %" in the description below unless otherwise noted.

<Synthesis of Resin 1>

To a solution prepared by mixing the components described below, 4 parts by mass of a polymerization initiator (trade name: V601, produced by Wako Pure Chemical Industries) is added. The interior of the flask is thoroughly purged with nitrogen and the mixture is heated in an oil bath under stirring so that the temperature of the system is 70° C. Stirring (polymerization) is continued as is for 5 hours. Then 74 parts by mass of trimethyl borate is added and stirring is continued for one more hour. Then the reaction solution is added to methanol dropwise, unreacted monomers are removed, and the solution is vacuum dried at 40° C. for 16 hours to obtain a resin 1. The resin 1 is analyzed to determine the content of the gel and the content of the gel having a boron crosslinked structure. The results are presented in Table 1.

| Components mixed | |
|---|---|
| Styrene | 296 parts by mass |
| Glycerin monomethacrylate (BLEMMER GLM produced by NOF Corporation) | 104 parts by mass |

<Synthesis of Resin 2>

A resin 2 is synthesized as with the resin 1 but without trimethyl borate. The resin obtained is analyzed to measure the content of the gel having a boron crosslinked structure. The results are presented in Table 1.

<Synthesis of Resin 3>

A resin 3 is synthesized as with the resin 1 except that the amount of styrene added is changed to 400 parts by mass and the amount of glycerin monomethacrylate added is changed to 0 parts by mass. The resin obtained is analyzed to measure the content of the gel having a boron crosslinked structure. The results are presented in Table 1.

<Synthesis of Resin 4>

A resin 4 is synthesized as with the resin 1 except that 104 parts by mass of glycerol methacrylate is used instead of glycerin monomethacrylate. The resin obtained is analyzed to measure the content of the gel having a boron crosslinked structure. The results are presented in Table 1.

<Synthesis of Resin 5>

A resin 5 is synthesized as with the resin 1 except that 100 parts by mass of triethyl borate is used instead of trimethyl borate. The resin obtained is analyzed to measure the content of the gel having a boron crosslinked structure. The results are presented in Table 1.

<Synthesis of Resin 6>

A resin 6 is synthesized as with the resin 1 except that 74 parts by mass of a tetramethylammonium salt of dicatechol borate (boron complex) is used instead of trimethyl borate. The resin obtained is analyzed to measure the content of the gel having a boron crosslinked structure. The results are presented in Table 1.

TABLE 1

| Resin | Content of boric acid or the like (parts by mass) | Content of gel having boron crosslinked structure (%) |
|---|---|---|
| 1 | 74 | 100 |
| 2 | 0 | 0 |
| 3 | 74 | 0 |
| 4 | 74 | 100 |
| 5 | 100 | 100 |
| 6 | 74 | 0 |

<Coating Layer-Forming Solution 1>

Resin 1: 2 parts

Styrene-perfluorooctylethyl methacrylate copolymer (copolymerization ratio=1:1, weight-average molecular weight; 58,000): 0.5 parts Carbon black (VXC-72 produced by Cabot Corporation); 0.12 parts Toluene: 14 parts These components and zirconia beads (particle size: 1 mm, having the same mass as toluene) are placed in a sand mill produced by Kansai Paint Co., Ltd., and stirred for 30 minutes at 1200 rpm to prepare a coating layer-forming solution 1.

<Coating Layer-Forming Solutions 2 to 6>

Coating layer-forming solutions 2 to 6 are prepared as with the coating layer-forming solution 1 except that the resin 1 is changed to the resins 2 to 6, respectively.

<Coating Layer-Forming Solution 7>

A coating layer-forming solution 7 is prepared as with the coating layer-forming solution 1 except that the amount of the resin 1 is changed from 2 parts to 2.5 parts.

<Coating Layer-Forming Solution 8>

A coating layer-forming solution 8 is prepared as with the coating layer-forming solution 1 except that styrene-perfluorooctylethyl methacrylate copolymer is changed to a polycyclohexyl methacrylate resin (produced by Soken Chemical & Engineering Co., Ltd., weight-average molecular weight: 65,000).

<Coating Layer-Forming Solution 9>

A coating layer-forming solution 9 is prepared as with the coating layer-forming solution 1 except the resin 1 is changed to a polymethyl methacrylate resin (weight-average molecular weight: 75,000, produced by Soken Chemical & Engineering Co., Ltd.). The polymethyl methacrylate resin has no crosslinked structure and a crosslinked structure is not formed in a process of forming a carrier (coating step) described below.

<Coating Layer-Forming Solution 10>

A coating layer-forming solution 10 is prepared as with the coating layer-forming solution 1 except the resin 1 is changed to an uncrosslinked melamine resin (produced by DIC Corporation, SUPER BECKAMINE J-820-60). This uncrosslinked melamine resin is a type of resin which does not have a crosslinked structure but forms a crosslinked structure when heated and dried in a wet coating method or when heated and melted in a dry coating method during the process (coating step) of making the carrier described below.

<Preparation of Carrier 1 (Wet Coating Method)>

Into a 5 L vacuum evacuation type kneader, 100 parts of magnetic particles DFC350 (core particles, produced by Dowa Mining Co., Ltd., Mn—Mg ferrite, average spacing Sm among irregularities in the surface: 0.4 μm) are placed. Thereto, 12 parts of the coating layer-forming solution 1 is added. The pressure is reduced to −200 mmHg at 60° C. while stirring the mixture, and the mixture is mixed for 20 minutes. The temperature is then increased and the pressure is reduced to 90° C. and =720 mHg, and the mixture is dried under stirring for 30 minutes. As a result, core particles with coating layers are obtained. The core particles are sieved through a 75 μm sieve to obtain a carrier 1. The flaking ratio of the carrier coating layers is calculated as described above and the results are presented in Table 2. The same measurement is also conducted for carriers described below. The results are also presented in Table 2.

<Preparation of Carriers 2 to 10 (Wet Coating Method)>

Carriers 2 to 10 are prepared as with the carrier 1 except that the coating layer-forming solution 1 is changed to the coating solutions 2 to 10, respectively.

<Preparation of Carrier 11 (Dry Coating Method)>

The resin 1 and a styrene-perfluorooctylethyl methacrylate copolymer (copolymerization ratio=1:1, weight-average molecular weight: 58,000) are separately pulverized by a jet mill. As a result, resin particles having a volume-average particle size of 5 μm and resin particles having a volume-average particle size of 3.5 μm are obtained.

One hundred parts of magnetic particles DFC350 (core particles, produced by Dowa Mining Co., Ltd., Mn—Mg ferrite), 1.7 parts of the resin particles of the resin 1 described above, 0.5 parts of the resin particles of the styrene-perfluorooctylethyl methacrylate copolymer described above, and 0.3 parts of carbon black are mixed with a V-type blender. The resulting mixture is placed in a 1 L horizontal kneader and stirred for 60 minutes at a jacket temperature set to 200° C. The mixture is kept stirring for another 60 minutes to cool and sieved through a 75 μm mesh. As a result, a carrier 11 is obtained.

The obtained carrier 11 is observed with a scanning electron microscope (SEM). The observation has found that the coating layers are formed evenly.

<Preparation of Carrier 12 (Dry Coating Method)>

The resin 5 is pulverized by a jet mill to obtain resin particles having a volume average particle size of 4 μm.

A carrier 12 is prepared as with the carrier 11 except that the resin particles of the resin 2 described above is used instead of the resin particles of the resin 1.

The obtained carrier 12 is observed with a scanning electron microscope (SEM). The observation has found that the coating layers are formed evenly.

<Preparation of Carrier 13 (Dry Coating Method)>

A carrier 13 is prepared as with the carrier 11 except that melamine crosslinked resin particles (EPOSTAR S produced by Nippon Shokubai Co., Ltd.) are used instead of the resin particles of the resin 1.

The obtained carrier 13 is observed with a scanning electron microscope (SEM). The observation has found that the coating layers are significantly uneven.

<Preparation of Toner 1>

—Polymerization of Crystalline Polyester Resin—

Into a three-necked flask dried by heating, 100 mass % of monomer component constituted by 100 mol % of decanedicarboxylic acid and 100 mol % of nonanediol, and 0.3 mass % of dibutyl tin oxide are placed. The air inside the flask is purged with nitrogen gas under reduced pressure to give an inert atmosphere, and refluxing is conducted for 5 hours at 180° C. under mechanical stirring.

The temperature is slowly increased to 230° C. under a reduced pressure and stirring is conducted for 2 hours. After the mixture has become viscous, the mixture is air-cooled to terminate reaction. As a result, a crystalline polyester resin is obtained by polymerization.

The molecular weight (polystyrene equivalent) is measured by gel permeation chromatography. The weight-average molecular weight (Mw) of the crystalline polyester resin is 23300 and the number-average molecular weight (Mn) is 7300.

The melting point (Tm) of the crystalline polyester resin is measured with a differential scanning calorimeter (DSC). A clear endothermic peak is observed at an endothermic peak temperature of 72.2° C.

—Preparation of Crystalline Polyester Resin Particle Dispersion—

Next, a resin particle dispersion having the following composition is prepared by using the crystalline polyester resin obtained.

Crystalline polyester resin: 90 parts

Ionic surfactant (NEOGEN RK produced by DAI-ICHI KOGYO SEIYAKU CO., LTD.): 1.8 parts Ion exchange water: 210 parts These components are heated to 100° C. and dispersed with ULTRA-TURRAX T50 produced by IKA, and heated to 110° C. with a pressure discharge-type Gaulin homogenizer to conduct dispersion treatment for 1 hour. As a result, a dispersion of crystalline polyester resin particles having an average particle size of 230 nm and a solid content of 30 mass % is obtained.

—Polymerization of Amorphous Polyester Resin—

Bisphenol A-ethylene oxide 2 mol adduct: 30 mol %

Bisphenol A-propylene oxide adduct: 70 mold

Terephthalic acid: 45 mol %

Fumaric acid: 40 mol %

Dodecenylsuccinic acid: 15 mol %

These monomers are placed in a 5 L flask equipped with a stirrer, a nitrogen inlet tube, a temperature sensor, and a rectifier. The temperature is raised to 190° C. over 1 hour. After confirming that the reaction system is being stirred, 0.8 mass % of tin distearate is added to 100 mass % of the feed monomers.

The temperature is raised to 240° C. from that temperature over 6 hours while distilling away water produced, and dehydration condensation reaction is continued at 240° C. for 3 more hours. As a result, an amorphous polyester resin having a glass transition temperature of 57° C., an acid value of 14.6 mgKOH/g, a weight-average molecular weight of 20,000, and a number average-molecular weight of 6,500 is obtained.

—Preparation of Amorphous Polyester Resin Particle Dispersion—

Amorphous polyester resin: 100 parts

Ethyl acetate: 50 parts

Isopropyl alcohol: 15 parts

Ethyl acetate and isopropyl alcohol are placed in a 5 L separable flask. The resin is then slowly added to the flask. The mixture is stirred with a three-one motor to obtain an oil phase by dissolution. To this oil phase under stirring, a 10 mass % aqueous ammonia solution is slowly added dropwise using a dropper so that the total amount of the aqueous solution is 3 parts by mass. Thereto, 230 parts by mass of ion exchange water is slowly added dropwise at a rate of 10 ml/min to conduct phase inversion emulsification. The solvent is removed while reducing the pressure with an evaporator. As a result, an amorphous polyester resin particle dispersion containing the amorphous polyester resin is obtained. The volume-average particle size of the resin particles dispersed in the dispersion is 150 nm. The resin particle concentration in the dispersion is adjusted to 30 mass % by using ion exchange water.

—Preparation of Colorant Dispersion—

Cyan pigment: Copper phthalocyanine C. I. Pigment Blue 15:3 (Dainichiseika Color and Chemicals Mfg. Co., Ltd.): 50 parts Anionic surfactant (NEOGEN SC produced by Dai-ichi Kogyo Seiyaku Co., Ltd.): 5 parts Ion exchange water: 200 parts These components are placed in a stainless steel round flask and mixed and dispersed with a homogenizer (ULTRA-TURRAX produced by IKA) for 10 minutes, and dispersed under a pressure of 245 Mpa by using Ultimaizer (impact-type wet pulverizer produced by Sugino Machine Limited) for 15 minutes. As a result, a colorant dispersion having a colorant particle center size of 182 nm and a solid content of 20.0 mass % is obtained.

—Preparation of Releasing Agent Dispersion—

Paraffin wax: HNP-9 (Nippon Seiro Co., Ltd.), 20 parts

Anionic surfactant: NEOGEN SC (Dai-ichi Kogyo Seiyaku Co., Ltd.), 1 part

Ion exchange water, 80 parts

These components are mixed in a heat-resistant container and heated to 90° C., followed by stirring for 30 minutes. Next, the melt is released from the bottom of the container and distributed to a Gaulin homogenizer. After conducting recirculation operation equivalent to 3 passes under a pressure of 5 MPa, the pressure is increased to 35 MPa and recirculation operation equivalent to 3 passes is further conducted. The resulting emulsion is cooled in the heat-resistant container to 40° C. or less. As a result, a releasing agent dispersion having a center particle size of 182 nm and a solid content of 20.0 mass % is obtained.

Crystalline polyester resin particle dispersion: 40 parts

Amorphous polyester resin particle dispersion: 170 parts

Colorant dispersion: 30 parts

Releasing agent dispersion: 40 parts

These components are mixed and dispersed in a stainless steel round flask using ULTRA-TURRAX T50. To the mixture, 0.20 parts of polyaluminum chloride is added and dispersion is continued by using ULTRA-TURRAX. The flask is heated to 45° C. under stirring in a hot oil bath. After the flask is retained at 45° C. for 60 minutes, 60 parts of the amorphous polyester resin particle dispersion is added.

After pH of the solution in the flask is adjusted to 8.0 by using a 0.5 mol/L aqueous sodium hydroxide solution, the stainless steel flask is sealed, heated to 90° C. while continuing stirring by using magnetic seal, and retained thereat for 3 hours.

Upon completion of the reaction, the mixture is cooled, filtered, washed with ion exchange water, subjected to solid-liquid separation by Nutsche suction filtration, and re-dispersed in 1 L of ion exchange water at 40° C. Then stirring and washing are performed for 15 minutes at 300 rpm.

This operation is further repeated five times. When pH of the filtrate is 7.5 and an electrical conductivity is 7.0 μS/cmt, solid-liquid separation is performed using a No. 5A paper filter by Nutsche suction filtration. Then vacuum drying is continued for 12 hours. As a result, toner particles 1 having a core-shell structure constituted by a core layer containing a crystalline polyester resin and an amorphous polyester resin and a shell layer that coats the core layer and contains an amorphous polyester resin are obtained.

The particle size of the toner particles 1 is measured. The volume-average particle size is 5.2 μm and the volume average particle size distribution index GSDv is 1.22. The shape factor SF1 determined by shape observation with a LUZEX image analyzer is 136.

Silica ($SiO_2$) particles having an average primary particle size of 40 nm, surfaces of which are hydrophobized with hexamethyldisilazane (also referred to as "HMDS" hereinafter), and metatitanic acid compound particles having an average primary particle size of 20 nm which are a reaction product between metatitanic acid and isobutyltrimethoxysilane are added to the obtained toner particles 1 so that the ratio (coverage) of the surfaces of the toner particles coated with these particles is 40%. The resulting mixture is mixed with a Henschel mixer to prepare a toner 1.

<Preparation of Toner 2>

A toner 2 is prepared as with the toner 1 except that an amorphous polyester resin particle dispersion is used instead of the crystalline polyester resin particle dispersion.

<Preparation of Developers 1 to 13>

The toner 2 is mixed with each of the carriers 1 to 13 so that the toner 2 content in the entire developer is 8 mass % to thereby prepare developers 1 to 13.

<Preparation of Developer 14>

The toner 1 is mixed with the carrier 12 so that the toner 1 content in the entire developer is 8 mass % to thereby prepare a developer 14.

<Evaluation 1>

Each of the developers thus prepared is loaded in a printer, DocuCenterColor 400 (modified so that the speed of the developer-carrying member is variable relative to the surface of the photoconductor (image-carrying member) and that the idle operation of the developing device before output is stopped) produced by Fuji Xerox Co., Ltd. The printer is moved to a 32° C., 92% RH environment and left therein for 8 hours. A solid image having an applied toner amount of 0.6 g/m$^2$ up to 10 cm from an edge of the image is prepared and ten printouts are made on A4 paper C$^2$ (produced by Fuji Xerox Co., Ltd.). The tenth printout is assumed to be the reference image.

Next, a character image corresponding to an image coverage of 3% is output on 10,000 sheets of A4 paper C$^2$ under the same environment and another 10,000 printouts are made the next day (24 hours later). The day following that day (24 hours later), a solid image having an applied toner amount of 0.6 g/m$^2$ up to 10 cm from the tip of the image is printed to make one printout. This printout is used as the image to be evaluated. The density of the image to be evaluated is compared with the reference image. Fogging in the lower portion (downstream side in the sheet transport direction) of the image to be evaluated is evaluated according to the following standard.

The ratio of the speed of the surface of the developer-carrying member relative to the surface of the photoconductor (the difference in speed between the surface of the photoconductor and the surface of the developer-carrying member (speed of the conductor surface:speed of the developer-carrying member surface)) is 1:2.

The speed of the surface of the photoconductor and the speed of the surface of the developer-carrying member are determined as follows:

$$\text{Speed of surface of photoconductor}=L\times R\ (\text{cm/min})$$

$$\text{Speed of surface of developer-carrying member}=l\times r\ (\text{cm/min})$$

where L (cm) represents the diameter of the photoconductor, R represents the number of rotation per minute of the photoconductor, l represents the diameter of the developer-carrying member, and r represents the number of rotation per minute of the developer-carrying member.

Fogging in the lower part of the image to be evaluated and the density of the image to be evaluated are evaluated as follows:

—Fogging in Lower Part of Image to be Evaluated—

Fogging occurring in a region up to 1 cm from a rear end (end on the downstream side in the sheet transport direction) of the image to be evaluated is observed with the naked eye and a magnifier (×20).

AA: No fogging is observed with the naked eye or magnifier

A: No fogging is observed with the naked eye but slight fogging is observed with a magnifier.

B: Slight fogging is observed with the naked eye but the extent is within the allowable range.

C: Fogging is clearly identifiable with the naked eye.

Samples rated B or higher are considered acceptable. The results are shown in Table 2.

—Density of Image Evaluated—

Image density analyzer (X-Rite 404A produced by X-Rite) is used to measure the image density of a solid portion (image portion) of the reference image and that of the image to be evaluated. The image density of the reference image is assumed to be 100%, and the image density of the image to be evaluated is indicated as a percentage with respect to this. The closer the image density is to 100%, the better. The target image density is 85% or more and less than 110%. An image density less than 85% or an image density of 110% or more are considered unacceptable. The results are presented in Table 2.

TABLE 2

| Developer | Carrier | Separation ratio of carrier coating layer (wt %) | Toner | Evaluation of fogging | Evaluation of image density | |
|---|---|---|---|---|---|---|
| 1 | 1 | 5 | 2 | B | 92 | Example |
| 2 | 2 | 30 | 2 | C | 110 | Comparative Example |
| 3 | 3 | 32 | 2 | C | 115 | Comparative Example |
| 4 | 4 | 6 | 2 | A | 95 | Example |
| 5 | 5 | 7 | 2 | A | 100 | Example |
| 6 | 6 | 28 | 2 | C | 115 | Comparative Example |
| 7 | 7 | 4 | 2 | A | 105 | Example |
| 8 | 8 | 8 | 2 | B | 90 | Example |
| 9 | 9 | 30 | 2 | C | 120 | Comparative Example |
| 10 | 10 | 1 | 2 | C | 80 | Comparative Example |
| 11 | 11 | 12 | 2 | A | 105 | Example |
| 12 | 12 | 12 | 2 | AA | 105 | Example |
| 13 | 13 | 35 | 2 | C | 120 | Comparative Example |
| 14 | 12 | 12 | 1 | A | 100 | Example |

<Evaluation 2>

The speed ratio of the developer-carrying member to the surface of the photoconductor is changed to 1:1.4, 1:1.5, 1:4, 1:5, and 1:5.1 and the developer 4 is used. The same evaluation as Evaluation 1 is conducted (evaluation of fogging and image density). The results are presented in Table 3.

TABLE 3

| Speed ratio | Evaluation of fogging | Evaluation of image density (%) |
|---|---|---|
| 1:1.4 | C | 80 |
| 1:1.5 | B | 85 |
| 1:4 | A | 95 |
| 1:5 | A | 90 |
| 1:5.1 | C | 85 |

The tables indicate that fogging is more suppressed in Examples than in Comparative Examples.

What is claimed is:

1. An electrostatic image developing carrier comprising:

a core particle; and a coating layer on the core particle, wherein the coating layer contains a resin having a crosslinked structure formed by using at least one compound selected from boric acid, organic boric acids, boric acid salts and boric acid esters, and wherein the coating layer further comprises at least one other resin, and the resin having a crosslinked structure is from 40 mass % to 70 mass % of the total of the resin having a crosslinked structure and the at least one other resin.

2. The electrostatic image developing carrier according to claim 1, wherein the electrostatic image developing carrier is prepared by heating a mixture of the core particle and the resin in a gas phase to attach the resin to the surface of the core particle.

3. The electrostatic image developing carrier according to claim 1, wherein the resin having a crosslinked structure is a resin selected from an acrylic resin, a styrene-acrylic resin, and a styrene-(meth)acrylic acid ester copolymer.

4. The electrostatic image developing carrier according to claim 3, wherein the resin is prepared by polymerizing an acryl monomer having a hydroxyl group.

5. The electrostatic image developing carrier according to claim 4, wherein the acryl monomer having a hydroxyl group is selected from glycerol acrylate, glycerol methacrylate, 2-hydroxyethyl acrylate, 2-hydroxyethyl methacrylate, 2-hydroxypropyl acrylate, and 2-hydroxypropyl methacrylate.

6. The electrostatic image developing carrier according to claim 1, wherein the at least one compound selected from boric acid, organic boric acids, boric acid salts and boric acid esters is selected from boric acid, trimethyl borate, triethyl borate, and triisopropyl borate.

7. The electrostatic image developing carrier according to claim 1, wherein the amount of the at least one of boric acid, organic boric acids, boric acid salts and boric acid esters is about 0.3 to about 5 parts by mass relative to 1 part by mass of the resin.

8. An electrostatic image developer comprising:

a toner; and the electrostatic image developing carrier according to claim 1.

9. The electrostatic image developer according to claim 8, wherein the resin having a crosslinked structure is a resin selected from an acrylic resin, a styrene-acrylic resin, and a styrene-(meth)acrylic acid ester copolymer.

* * * * *